United States Patent [19]

Elpern

[11] Patent Number: 4,717,318

[45] Date of Patent: Jan. 5, 1988

[54] TURBOCHARGER HEAT TRANSFER CONTROL METHOD AND APPARATUS

[75] Inventor: David G. Elpern, Los Angeles, Calif.

[73] Assignee: The Garrett Corporation, Los Angeles, Calif.

[21] Appl. No.: 884,317

[22] Filed: Jul. 11, 1986

Related U.S. Application Data

[63] Continuation of Ser. No. 681,531, Dec. 14, 1984, abandoned.

[51] Int. Cl.[4] ..... F04B 17/00

[52] U.S. Cl. ..... 417/407; 415/114

[58] Field of Search ..... 417/405, 406, 407; 165/47 A, DIG. 4; 415/114

[56] References Cited

U.S. PATENT DOCUMENTS

| | | | |
|---|---|---|---|
| Re. 30,333 | 7/1980 | Gordon, Jr. et al. | 417/407 |
| 3,565,167 | 2/1971 | Eder | 165/47 |
| 3,754,398 | 8/1973 | Mattavi | 165/DIG. 4 |
| 4,068,612 | 1/1978 | Meiners | 60/605 |

FOREIGN PATENT DOCUMENTS

| | | | |
|---|---|---|---|
| 922093 | 1/1955 | Fed. Rep. of Germany | 417/407 |
| 3430146 | 3/1985 | Fed. Rep. of Germany | 417/407 |
| 45722 | 3/1985 | Japan | 417/407 |

*Primary Examiner*—Louis J. Casaregola
*Assistant Examiner*—Timothy S. Thorpe
*Attorney, Agent, or Firm*—Terry L. Miller; James W. McFarland

[57] ABSTRACT

A turbocharger includes spaced apart turbine housing and compressor housing sections which are connected by a center housing section. The center housing section journals an elongate shaft carrying at opposite ends thereof a compressor wheel and a turbine wheel rotatable in the respective housing sections. The center housing section also defines a closed cavity captively receiving a material conductive of heat and which transitions between lower and upper molecular energy levels during hot soak of the turbocharger following engine shutdown to control bearing temperature at the shaft.

5 Claims, 4 Drawing Figures

TURBOCHARGER HEAT TRANSFER CONTROL METHOD AND APPARATUS

This application is a continuation of application Ser. No. 681,531 filed Dec. 14, 1984, now abandoned.

BACKGROUND OF THE INVENTION

The field of this invention is turbochargers of the type used to provide pressurized combustion air to an internal combustion engine. More particularly, this invention relates to a turbocharger including a housing journaling an elongate shaft for rotation with a turbine and a compressor. The turbine and compressor are spaced apart at opposite ends of the shaft, and the housing defines a closed void substantially surrounding the shaft. A quantity of material having selected heat transfer and heat absorptive qualities is disposed within the closed void for controlling the temperature of both the shaft and housing bearings following engine shutdown.

Turbochargers in general are well known in the pertinent art for supplying pressurized combustion air to an internal combustion Otto or Diesel cycle engine. Historically turbochargers have been used on large engines for stationary or heavy automotive farm or construction vehicle applications. These turbocharges generally include a housing including a turbine housing section for directing exhaust gases from an exhaust inlet to an exhaust outlet across a rotatable turbine. The turbine drives a shaft journaled in the housing. A compressor is driven by the shaft and spaced from the turbine housing section. A compressor housing section receives the compressor and defines an air inlet for inducting ambient air and an air outlet for delivering the air pressurized to an inlet manifold of the engine.

Because these past turbocharger applications involved relatively low specific engine power outputs with relatively low exhaust gas temperatures and infrequent engine shutdowns no special precautions were necessary to cool the shaft and the bearings journaling the shaft. Experience showed that the usual engine pressure oil flow lubrication which was necessary during turobcharger operation also by its cooling effect maintained the shaft and bearings at a temperature low enough to prevent oil coking in the turbocharger after engine shutdown. Because the operating temperature of the hot turbine end of the turbocharger was low enough and the mass of the turbocharger relatively large, the highest temperature experienced at the shaft and bearings after the oil flow was stopped was not high enough to degrade or coke the oil remaining in the turbocharger after engine shutdown.

However, passenger car automotive turbocharger applications have brought to light many problems. The specific engine outputs are usually higher leading to higher exhaust gas temperatures. The turbocharger itself is considerably smaller than its heavy equipment predecessor so that a smaller thermal mass is available to dissipate residual heat from the turbine housing section and turbine after engine shutdown. The result has been that heat soaking from the turbine housing section and turbine into the shaft and remainder of the housing raise the temperature high enough to degrade or coke the remaining oil in the housing after engine shutdown. Of course, this coked oil may plug the bearings so that subsequent oil flow lubrication and cooling is inhibited. This process soon leads to bearing failure in the turbocharger.

An interim and incomplete solution to the above problem was provided by the inclusion of a hydraulic accumulator with a check and metering valve in the oil supply conduit between the engine and turbocharger. During engine operation this accumulator filled with pressurized oil. Upon engine shutdown the oil was allowed to flow only to the turbocharger at a controlled rate to provide bearing and shaft cooling while the remainder of the turbocharger cooled down. However, the frequent shutdowns and restarts to which automotive passenger vehicles are sometimes subjected does not allow sufficient time for filing of the accumulator. Under these conditions failure of the turbocharger may be accelerated.

Another more recent and more successful solution to the above problem has been the provision of a liquid cooling jacket in a part of the turbine housing adjacent to the turbine housing section. Liquid engine coolant is circulated through the jacket during engine operation by the cooling system of the engine. Following engine shutdown the coolant remaining in the jacket provides a heat sink so that residual heat from the turbine housing section does not increase the shaft and bearing temperatures to undesirably high levels. U.S. Pat. Nos. 4,068,612 of E. R. Meiners, and Re. 30,333 of P. B. Gordon, Jr., et al, illustrate examples of this conventional solution to the problem.

However, this latter class of turbochargers all require that engine coolant be piped to and from the turbocharger. This is usually accomplished with flexible hoses which complicate and increase the cost of the original installation of the turbocharger. Also such plumbing requires additional maintenance and may be subject to coolant leakage which could disable the vehicle.

SUMMARY OF THE INVENTION

In view of the above, it is an object for the present invention to provide a method of limiting the temperature at the shaft and bearings of a turbocharger following engine shutdown without the use of liquid engine coolant and the attendant plumbing that such coolant use involves.

A further object is to provide a turbocharger which except for the necessary air, exhaust gas and lubricating oil connections with the engine is a unit unto itself and is not reliant upon the cooling system of the engine to prevent overtemperature conditions within the turbocharger.

The present invention provides the method of controlling the heat transfer within a turbocharger following engine shutdowns by providing a captive mass of heat conductive and heat absorptive material which during turbocharger operation exists in a relatively low energy molecular state and which upon engine shutdown and the attendant cessation of cooling oil flow both absorbs residual heat from the turobcharger turbine housing section with an attendant phase change, and provides a heat transfer path from the turbine housing section to other relatively cool portions of the turbocharger bypassing the heat transfer path including the shaft and bearings where oil coking may occur.

More particularly, the present invention provides a turbocharger including a housing journaling an elongate shaft therein, a turbine drivingly carried at one end of said shaft and a compressor drivingly carried at the opposite end of the shaft, a turbine housing section defining an exhaust gas inlet to and an exhaust gas outlet from the turbine, an inlet housing section similarly providing an air inlet to and an air outlet from the compressor, the housing defining a closed cavity substantially surrounding the shaft and extending between the turbine housing section and inlet housing section, and a determined quantity of material captively disposed in the cavity which during turbocharger operation at a normal temperature exists at a first lower molecular energy level and with increasing temperature during transfer thereto of residual heat from the turbine housing section absorbs the heat with an attendant change of phase to a second higher molecular energy level.

DETAILED DESCRIPTION OF THE PREFERRED EMBODIMENT

Figure 1:
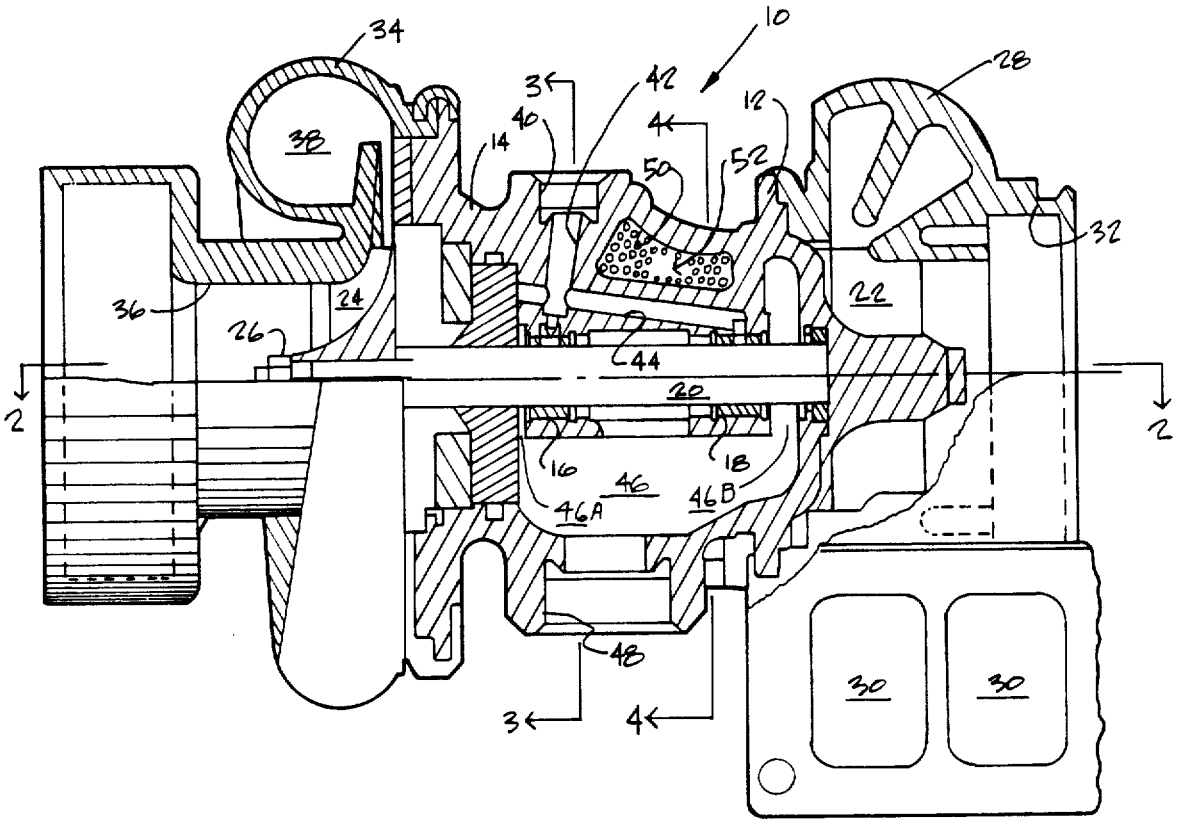
FIG. 1 is a longitudinal somewhat schematic view partly in cross section of a turbocharge embodying the present invention.

With reference to FIG. 1, a turbocharger 10 includes a housing generally referenced with the numeral 12. Housing 12 includes a center section 14 receiving a pair of spaced apart journal bearings 16, 18, and rotatably receiving therein an elongate shaft 20. A turbine wheel 22 is attached to or integrally formed with one end of shaft 20. At the opposite end of shaft 20 a compressor wheel 24 is carried thereon and drivingly secured thereto by a nut 26 threadably engaging the shaft.

A turbine housing section 28 mates with the center section 14 and defines an exhaust gas inlet 30 leading to a radially outer portion of the turbine wheel 22. The turbine housing section also defines an exhaust gas outlet 32 leading from the turbine wheel 22. Similarly, a compressor housing section 34 mates with the housing center section 14 at the end thereof opposite the turbine housing section 28. The compressor housing section 34 defines an air inlet 36 leading to the compressor wheel 24, and an air outlet (not shown) opening from a diffuser chamber 38.

Figure 2:
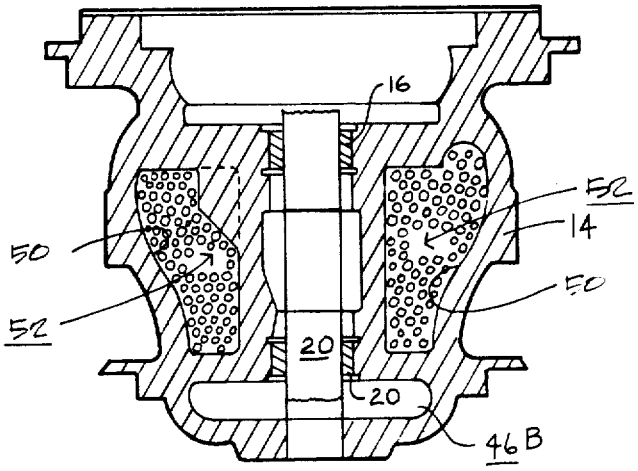
FIG. 2 is a fragmentary cross sectional view taken along line 2—2 of FIG. 1.
Figure 3:
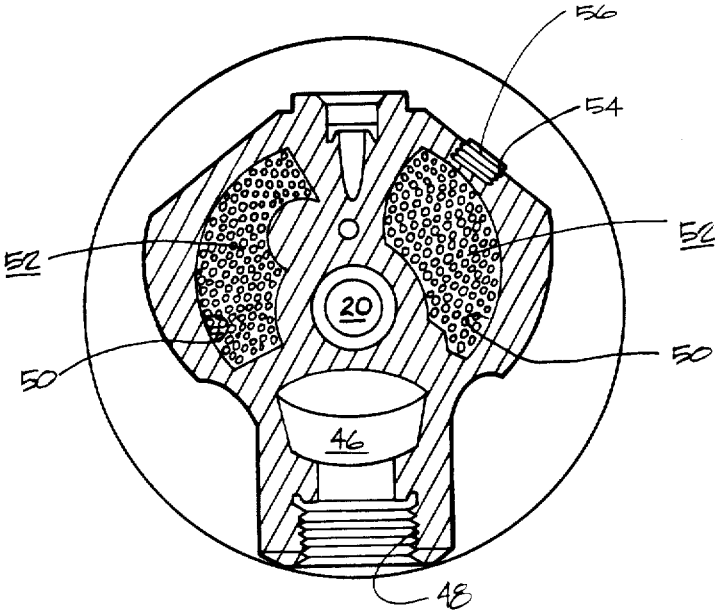
FIG. 3 is a fragmentary cross sectional view taken along line 3—3 of FIG. 1.
Figure 4:
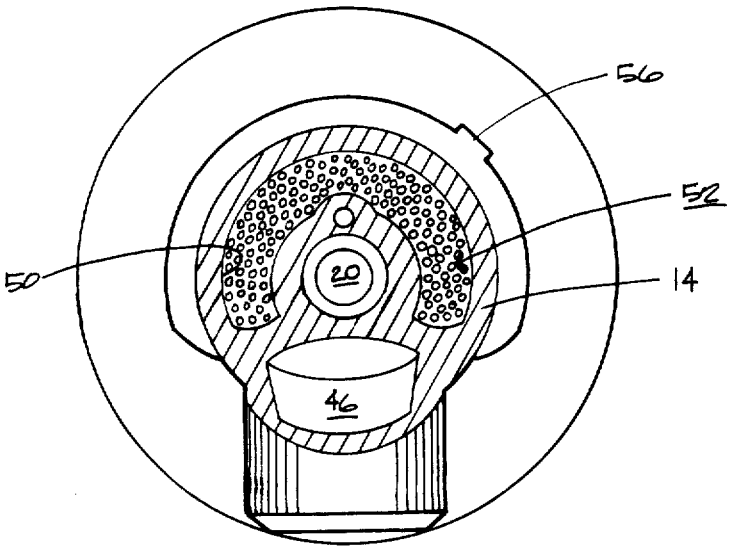
FIG. 4 is a fragmentary cross sectional view taken along line 4—4 of FIG. 1.

The turbocharger center section 14 also defines an oil inlet 40 leading to the bearings 16, 18 via passages 42, 44, and an oil drain gallery 46 leading from the bearings to an oil outlet 48. Also defined within the housing center section 14 is a closed cavity 50 which is best depicted viewing FIGS. 2–4. The cavity 50 extends axially between the compressor housing section and turbine housing section of the housing 14. Cavity 50 also extends circumferentially over the top and part way down each side of the shaft 20, viewing FIGS. 3 and 4. Thus, it can be envisioned that cavity 50 envelopes the shaft 20 and bearings 16, 18 somewhat in the shape of a saddle.

Disposed within the cavity 50 is a predetermined quantity of a material 52 selected with a view to, among other factors, it heat transfer coefficient, its chemical stability under thermal cycling, its cost, and its heat of fusion or other change of phase heat capacity. Also of particular importance with respect to the material 52 is the temperature at which such change of phase heat absorption and heat release takes place.

During manufacturing of the turbocharger 10, the material 52 is loaded into the cavity 50 preferably in a solid pellet or granular form via a port 54 opening thereto. After the cavity 50 is substantially filled with material 52, the port 54 is permanently closed by a plug 56 which threadably engages the housing center section 14. By way of example only, the plug 56 may be removably secured to housing section 14 by an anaerobic adhesive, or may be permanently secured thereto as by welding. In either case, the plug 56 is intended to permanently close the port 54 so that the cavity 50 is closed for the service life of the turbocharger 10. Consequently, the material 52 is permanently captured within the cavity 50. It will be noted that because the material 52 is loaded into cavity 50 in the form of pellets or granules, it has been so illustrated in the drawing figures. However, after the first time turbocharger 10 is operated on an engine and following hot shutdown thereof, the material 52 exists in cavity 50 as a fused mass.

Having observed the structure of turbocharger 10, attention may now be directed to its operation. During operation of an internal combustion engine (not shown) associated with turbocharger 10, high temperature and pressure exhaust gasses enter the housing 12 via exhaust gas inlet 30. These exhaust gasses flow from inlet 30 to outlet 32 while expanding to a lower pressure and driving turbine wheel 22. The turbine wheel 22 drives shaft 20 which also carries compressor wheel 24. Consequently, compressor 24 draws in ambient air via inlet 36 and discharges the same pressurized via an outlet (not shown) communicating with chamber 38. The exhaust gasses flowing within the turbine section of housing 12 also act as a substantially continuous source of heat which is transferred to housing 12 and turbine wheel 22 so long as the engine and turbocharger 10 are in operation. Consequently during operation of the turbocharger 10, heat is almost continuously conducted from the hot turbine housing section 28 and turbine wheel 22 to the cooler portions of the turbocharger. This heat transfer occurs by conduction along shaft 20 and turbine housing center section 14, leftwardly viewing FIG. 1.

At the same time, a flow of relatively cool lubricating oil is received via inlet 40 and passages 42, 44. This cooling oil flow by its traverse through passages 42, 44, its flow from bearings 16, 18, and its flow across the internal surfaces of oil drain gallery 46 absorbs heat from and cools the turbocharger 10. The turbocharger 10 also liberates heat to its environment by radiation and convection from external surfaces. Also, heat may be transferred to air traversing the compressor wheel 24 and flowing to the air outlet via chamber 38. The summation of these heat transfer effects results in the bearings 16, 18 operating at temperatures low enough to prevent oil coking therein. Further the material 52 is maintained in a relatively low energy molecular state.

Upon shutdown of the engine supplying exhaust gasses to inlet 30, both the source of heat energy and the source of cooling oil flow to the turbocharger cease to operate. However, both the turbine housing section 28 and turbine wheel 22 are hot and hold a considerable quantity of residual heat. This residual heat is conducted to the cooler parts of the turbocharger much as heat was conducted during operation thereof. However, no cooling oil flow is now present. Consequently, the temperature of shaft 20 and center housing 14 progressively increase over their normal operating temperatures. This temperature increase, if uncontrolled could result in temperatures at bearings 16, 18, and particularly at the latter, which would degrade or coke the residual oil therein.

In order to control the heat transfer within turobcharger 10, the material 52 serves both to conduct heat from the hot turbine housing section 28 toward the cooler compressor housing section 34 via a path which is apart from the shaft 20 and bearings 16, 18, but also to absorb heat energy by a molecular change of phase. The material 52 is selected with a view to the normal expected operating temperatures of center housing 14 so that at a certain higher temperature a change of phase to a higher energy state takes place. This change of phase is accompanied by the absorption of a considerable quantity of heat. As a result, the temperatures at bearings 16, 18 do not reach levels which would coke the oil therein. Of course, with the passage of time the entire turbocharger 10 cools as it liberates heat to its surroundings.

By way of example, the applicant has discovered that an alloy of tin and lead which is used as common low-temperature solder will, if employed as the material 52, give surprisingly good results. A test of the turbocharger of FIG. 1 with the cavity 50 empty resulted in heat soaking from the turbine housing and turbine wheel to bearings 16 and 18 so that maximum temperatures of 450° F. and 640° F., respectively, were reached at each bearing. There temperatures compare with normal operating temperatures of 225° F. and 310° F., respectively, and are high enough at bearing 18 to coke the residual oil therein. These temperatures are comparable to those which would be expected in a conventional turbocharger with no center housing cooling of any type.

On the other hand, when the solder alloy was employed in cavity 50, the maximum bearing temperatures were 480° F. and 525° F., respectively, during a heat soak test under otherwise the same conditions as above. Significantly, the maximum temperature reached at bearing 18 was 115° F. lower than that experienced without the material 52 is cavity 50. The 30° F. higher temperature reached at bearing 16 is an indication that even though the material 52 absorbs a significant quantity of heat during its phase change it also conduits heat to the cooler portions of the turbocharger. This latter effect of the material 52 in cavity 50 is of considerable benefit itself because the cool compressor housing section is capable of absorbing considerable residual heat. Also, this compressor housing section also provides additional radiation and convection cooling surface area which is an aid to rapid cooling of the turbocharger. All of these effects in concert cooperate to limit the maximum temperature reached at bearing 18 so as to prevent oil coking therein.

Upon restart of the engine associated with turbocharger 10, if significant residual heat yet remains, the initial air flow through compressor housing section 34 will dissipate the heat therein. Likewise, the initial oil flow through the center housing section 14 will quickly lower the temperature therein to normal levels. As a result of this cooling upon a return to normal operation of the turbocharger, the material in cavity 52 is also cooled and experience a heat-releasing phase change to its lower-energy molecular condition. The heat released by this cooling phase change is substantially absorbed by the cooling oil flow through the center housing. As a result, the turbocharger 10 well endures frequent shutdowns and restarts of its associated engine.

An advantage of the present invention in addition to the elimination of engine coolant plumbing to the turbocharger and attendant simplified installation and maintenance, is its particular utility with air-cooled engines. These engines have no liquid engine coolant which could be used in the conventional way to cool a turbocharger. Consequenlty, turbocharger applications to these engines have conventionally involved many problems. The present invention is believed to provide a substantially complete solution to this difficult turbocharger application problem.

While the present invention has been depicted and described with reference to one preferred embodiment of the invention, no limitation upon the invention is inferred by such reference, and none is to be implied. The invention is intended to be limited only by the spirit and scope of the appended claims, which also provide a disclosure and definition of the invention.

I claim:

1. A turbocharger comprising a housing having a pair of axially spaced bearing members journaling an elongate shaft therein, a turbine wheel drivingly carried at one end of said shaft, and a compressor wheel drivingly carried at the opposite end of said shaft, said housing defining an exhaust gas inlet to said turbine wheel and an exhaust gas outlet therefrom, said housing further defining an air inlet to said compressor wheel and an air outlet therefrom, said housing completely defining a closed cavity substantially surrounding said shaft and extending between said turbine wheel and said compressor wheel, said closed cavity being substantially of inverted U-shape in transverse section to embrace said pair of bearing members and said elongate shaft while being spaced therefrom, said housing further defining an oil drain gallery below said shaft, said closed cavity including a pair of depending leg portions extending downwardly toward but short of said oil drain gallery, said oil drain gallery also extending axially between said turbine wheel and said compressor wheel and having a greater axial extent than said closed cavity and including a first and a second axially spaced apart upwardly extending portions respectively interposing axially between said turbine wheel and said compressor wheel and the one of said pair of axially spaced bearing members proximate to each of said wheels and surrounding said shaft, said clsoed cavity and said oil drain gallery intermeshing to embrace said pair of bearing members in surrounding relationship therewith, and a determined quantity of heat conductive and heat absorptive material captively received within said closed cavity.

2. The invention of claim 1 wherein said housing further defines an upper oil inlet leading to a depending oil passage, said oil passage opening to said shaft, said saddle-shaped closed cavity embracing but being spaced from said oil passage to substantially surround said shaft.

3. The invention of claim 1 wherein said housing further defines a port opening outwardly from said closed cavity, and plug means for closing said port secured sealingly with in said port.

4. The invention of claim 1 wherein said material comprises a metal.

5. The invention of claim 4 wherein said material comprises an alloy invention lead and tin.

* * * * *

UNITED STATES PATENT AND TRADEMARK OFFICE

CERTIFICATE OF CORRECTION

PATENT NO. : 4,717,318

DATED : JANUARY 5, 1988

INVENTOR(S) : DAVID G. ELPERN

It is certified that error appears in the above-identified patent and that said Letters Patent is hereby corrected as shown below:

At column 6, line 48 (Claim 1), delete "clsoed", insert -- closed --;

At column 6, line 66 (Claim 5), delete "invention", insert -- including --.

Signed and Sealed this

Twenty-first Day of June, 1988

*Attest:*

*Attesting Officer*

DONALD J. QUIGG

*Commissioner of Patents and Trademarks*